United States Patent [19]

Dolan

[11] Patent Number: 4,635,302

[45] Date of Patent: Jan. 13, 1987

[54] TOILET BOWL CLEANER DISPENSER

[76] Inventor: John E. Dolan, 15 New Main St., Haverstraw, N.Y. 10927

[21] Appl. No.: 788,681

[22] Filed: Oct. 17, 1985

Related U.S. Application Data

[63] Continuation of Ser. No. 540,433, Oct. 11, 1983, abandoned.

[51] Int. Cl.[4] ..... E03D 9/03

[52] U.S. Cl. ..... 4/228

[58] Field of Search ..... 4/227, 228

[56] References Cited

U.S. PATENT DOCUMENTS

| | | | |
|---|---|---|---|
| 668,762 | 2/1901 | Thompson | 4/228 |
| 1,091,374 | 3/1914 | Miller | 4/228 |
| 3,504,384 | 4/1970 | Radley et al. | 4/228 |
| 3,769,640 | 11/1973 | Castronovo | 4/228 |
| 4,365,362 | 12/1982 | Corey | 4/228 |

*Primary Examiner*—Charles E. Phillips
*Attorney, Agent, or Firm*—John F. Ohlandt

[57] ABSTRACT

An automatic toilet bowl cleaner dispenser for automatically discharging a measured amount of bleach (or detergent, or both) from a container which has an unobstructed opening, preferably in its top surface, through which tank water can enter the container and form a reservoir; a first venting means is located above the container's top surface for venting air responsive to the intake of tank water through the intake opening, and for defining the measured amount of cleaning solution; the venting means is in the form of a straight tube closed at its upper end, but provided with a small opening at the side of the tube adjacent the upper end; in operation the cleaning solution is the reservoir rises within the tube; however, because of this precise construction, very little cleaning solution escapes when water is rising within the toilet tank; when the water in the tank is lowered, the cleaning solution in the venting means forces out an equivalent amount of cleaning solution through the intake opening and into the flush water; additionally, because of the side opening in the tube, an incremental amount of tank water flows into the tube and forces out a corresponding added amount of cleaning solution; a further tube is provided extending from the first obstructed opening downwardly within the container, whereby mixing action is promoted when the tank water is being flushed and the cleaning solution is being dispensed; a second venting means, which is in the form of a bent tube, and a second corresponding unobstructed opening are optionally provided, both of which are in communication with a second compartment containing bleach.

6 Claims, 7 Drawing Figures

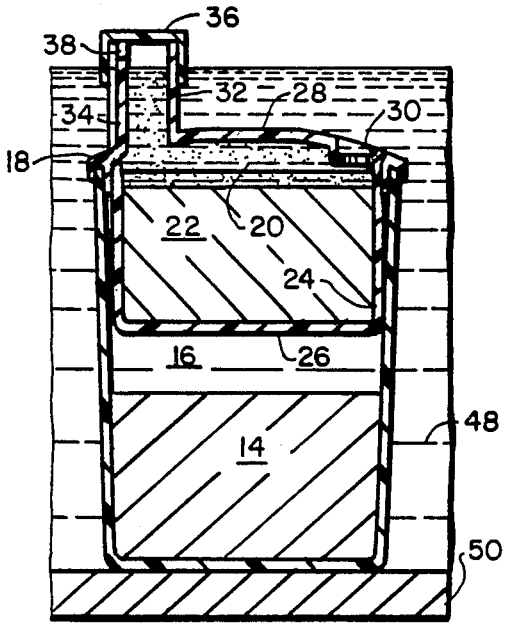
FIG. 4
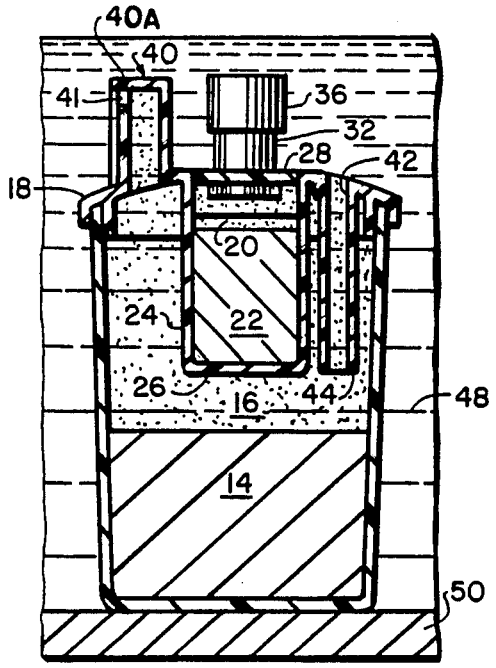
FIG. 5
FIG. 6
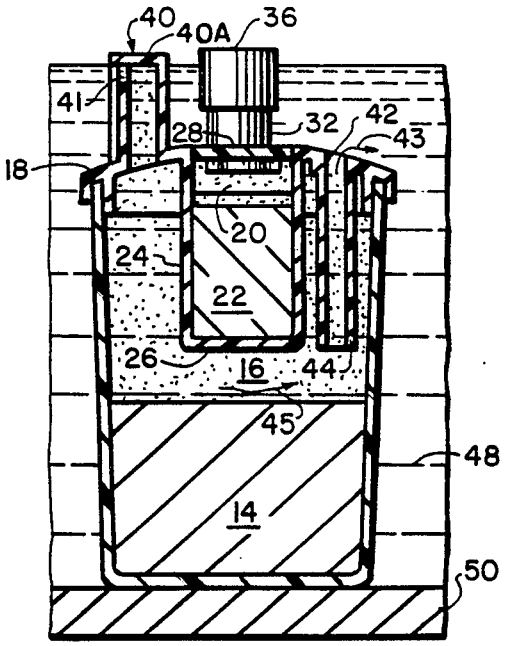
FIG. 7
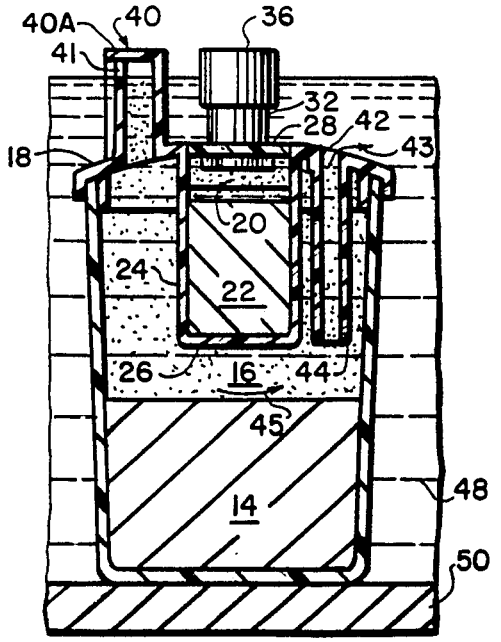

TOILET BOWL CLEANER DISPENSER

This application is a continuation of Ser. No. 06/540,433, filed Oct. 11, 1983, now abandoned.

BACKGROUND OF THE INVENTION

This invention relates to an automatic toilet bowl cleaning dispenser, and more particularly, to a device for dispensing materials useful for cleaning and disinfecting toilet bowls and the like.

The present invention relates to improvements in dispensing devices for automatically delivering bleach, or detergent, or both, to a charge of water; and particularly, to a dispenser containing a bleach or detergent that is soluble in water and which delivers, during a precisely timed, short interval in the flushing of the toilet tank, a measured amount of solution of one or more of such materials to the flushing water.

A variety of devices for automatically dispensing cleaning solutions into toilet bowls have been known in the art, and those which are believed to relate most closely to the present invention are disclosed in the following U.S. Pat. Nos.:

650,651; Williams et al;
969,729; Smith;
1,091,374; Miller;
1,175,032; Williams;
2,579,045; Levitt;
3,778,849; Foley;
3,781,926; Levy;
3,952,339; Baur et al.

U.S. Pat. No. 1,091,374 describes a disinfectant distributor which, in an example illustrated in its FIG. 2, is designed for the use of a liquid disinfectant heavier than water. To accomplish its purposes, the distributor is provided with a vertically disposed disinfectant or discharge tube terminating at its lower end a suitable distance above the bottom of the receptacle, the discharge tube being fitted at its upper end within an opening in a stopper, the upper end of such discharge tube terminating flush with the top of the stopper, and being provided with a gravity closing check valve. The described device also includes a displacement tube, or intake tube, which is always open and extends through the stopper above the receptacle. Whatever the merits of such device, the inclusion of a check valve results in preventing the flush water from entering the discharge tube. In addition, in the Miller patent, the upper end of the displacement tube is designed to terminate slightly below the maximum level of the flush water when the tank is full.

U.S. Pat. No. 3,781,926 relates to a cylindrical dispenser having a double-walled cap, one wall being rotatable with respect to the other, and each wall being provided with tiers of one or more openings which may be variably registered. As a consequence, adjustability is achieved as to the amount of cleaning solution which will be dispensed.

U.S. Pat. No. 3,952,339 also concerns an automatic toilet bowl cleaning device which is described as having a specially designed oval shape for the container, and which includes a standpipe having an opening to allow the flushing water to enter the container. This device also includes holes in its top or cover member so as to provide venting of air from the container.

The other patents cited include a siphon mechanism of one type or another, the common objective appearing to be the control of dispensing of cleaning solution responsive to the well known cut-off effect which occurs, upon flushing of the tank, when the water level within the dispenser drops below the short arm of the siphon mechanism.

Whatever the purposes and accomplishments of the device described in the aforecited references, none of them fulfills the objects of the present invention.

The present invention also relates to the dispenser device described in a related application of the present applicant; that is, copending application Ser. No. 421,170 filed Sept. 22, 1982.

The present invention has for its primary object to overcome a fundamental difficulty which arises in the context of dispensing cleaning solutions into toilet bowls, namely, the lack of precise control over the discharge of the cleaning solution into the tank water. Specifically, it is highly desirable that the bleach or detergent and the like be discharged in a single shot or burst at a prescribed point in the flushing cycle. The reason for this is that 80% of the tank water is normally flushed down the drain, while 20% flushed therefrom remains in the toilet bowl. Since the important consideration is to have the bleach, or detergent, or both, remain in the bowl for a sufficient period, it is important to have the proper timing so that the bleach or detergent will be dispensed in this 20% of the tank water that flows into and remains in the toilet bowl upon flushing of the toilet tank.

It will also be appreciated that from an economical standpoint, one wants to dispense the minimum amount of bleach or detergent required to do the job. Accordingly, it is advantageous to dispense only the minimum dose amount required in a single shot or burst and, of course, to do so at the appropriate time in the flushing cycle.

Accordingly, it is another primary object of the present invention to provide an efficient toilet bowl cleaner dispensing device that will dispense a minimum dose amount of the cleaning solution in an appropriately timed fashion.

An ancillary object is to dispense the bleach in the aforedescribed manner utilizing a technique similar to that disclosed in related application Ser. No. 421,170; at the same time, to dispense the detergent such that the "shot" or dose amount can be larger than the capacity of the venting tube or "tower" utilized for such purpose.

Yet another primary object is to force cleaning material, particularly the detergent solution, through the lower portion of the container so as to eliminate just skimming off the top layer.

SUMMARY OF THE INVENTION

In fulfillment of the above-stated objects, a primary feature of the invention resides in a particular construction for the upstanding venting tube or "tower" which serves as a dose-defining venting means for the detergent solution. This tube is permanently closed at its upper end but is provided with a side opening adjacent the upper end. As a result, the detergent solution begins to be dispensed as soon as the tank water level drops down in the flushing cycle to the upper end of the tube. This permits tank water outside the tube to enter and to continue to flow into the venting tube until the water level drops sufficiently (typically about one-fourth inch). Accordingly, the dose amount or "shot" that is dispensed can be larger than the capacity of the tube.

It is to be especially noted that, unlike certain known dispensing devices adapted for use in toilet tanks, the unique construction just described avoids the drawback of excessive dispensing of cleaning solution as the tank water is rising. In other words, precisely because of the side opening in the venting tube, very little cleaning solution escapes. The small amount that does escape in this situation is tolerable. However, the second tube or tower communicating with the bleach compartment in a particular embodiment to be described, has a "bent tube" configuration similar to that described in copending application Ser. No. 421,170. The bent tube effect is realized by means of a cap which fits over the upper end of the specially designed venting tube associated with bleach dispensing.

Another feature of the invention is based on the discovery that the cleaning solution, that is the detergent solution, tends to layer, with the result that a relatively weak solution is skimmed off the top in the ordinary course. Therefore, a special tube is provided which extends from the intake opening downwardly within the container. However, the intake opening remains completely unobstructed from the outside so that as the tank water is rising, it will flow in an unimpeded manner into the container.

Another feature resides in the construction of the compartment for holding the bleach such that the compartment depends from the main cover for the container and occupies a relatively small part of the total volume of the container. The balance of the container volume is taken up by the detergent compartment. This feature contrasts with the arrangement in applicant's copending application Ser. No. 421,170 in which the container is divided longitudinally into two halves for co-dispensing of two different cleaning materials, the two compartments of that unitary construction being equal in size.

Other and further objects, advantages and features of the present invention will be understood by reference to the following specification in conjunction with the annexed drawing, wherein like parts have been given like numbers.

BRIEF DESCRIPTION OF THE DRAWING

FIG. 4 is a cross sectional view taken on the line 4—4 of FIG. 1.

FIG. 5–FIG. 7 depict in cross sectional views several stages in the operation of the dispenser.

DESCRIPTION OF PREFERRED EMBODIMENT

Figure 1:
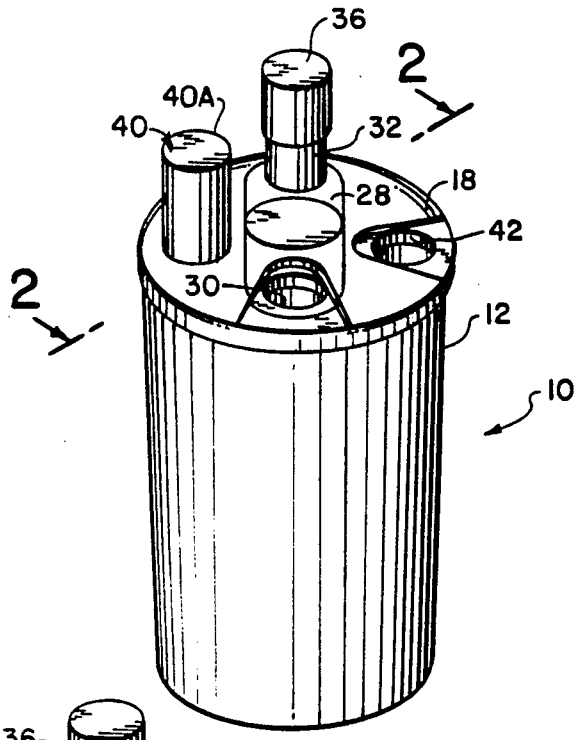
FIG. 1 is a perspective view of a preferred embodiment of the toilet bowl cleaner dispenser.

Referring now to the figures of the drawing, there will be seen a preferred embodiment of a dispensing device 10 comprising a hollow cylindrical container 12 in which there is disposed a block of detergent cleaning material 14 which substantially fills the lower part of a compartment 16 defined at the interior of the container. A top wall 18 closes the container, being typically formed as a cover. However, it will be understood that the entire container 12 can be suitably molded as a single disposable unit such that a cover is not required.

Another compartment 20 is provided in a hollow, generally box-like, structure in which compartment there is disposed bleach material 22. The compartment 20 depends from the cover 18, being defined by peripheral wall 24 and bottom wall 26. A cover 28 is press-fitted into a suitable opening in the main cover 18 so that access may be had to the normally closed compartment 20. An intake-discharge opening 30 is formed in the cover 28 so that tank water may enter bleach compartment 20, and exit therefrom at appropriate stages. An upstanding tubular member 32 serving as a venting means associated with compartment 20 is provided with an axially extending peripheral groove 34 which is concavely formed by suitable molding. A removable cap 36 fits over the open end of tube 32 to define, with the groove 34 and an opening 38, a so-called bent tube effect, by which an automatic stop to the rise of cleaner solution in tube 32 is brought about, due to the air trapped inside the tube when the tank water reaches the rim of cap 36. In other words, a liquid seal is effectuated at such rim. This bent tube effect has been fully explained in copending application Ser. No. 421,170, which application is incorporated herein by reference. The bent tube effect is implemented in this manner because of the ease of molding this particular configuration, compared with a more or less conventional bent tube.

It will be seen that an additional upstanding tubular member 40 is provided to serve as a further venting means in communication with compartment 16, defined at the interior of container 12. This tubular member 40 is closed at its upper end by means of an end wall 40A; and immediately adjacent such upper end is an opening 41 (typically one-fourth inch by one-fourth inch) for purposes to be described. A corresponding intake-discharge opening 42 is provided in the cover 18 directly opposite the tubular member 40. This opening permits intake of flush water as such water is rising, and also permits discharge of detergent solution from compartment 16. Extending from this opening is a special tube 44 constituting a feature of the present invention.

Because it has been discovered that a "layering effect" takes place within the container, the tube 44 is adapted to extend downwardly for a substantial distance within compartment 16. In the ordinary course, what happens is a skimming off of the top layer, which comprises a relatively weak cleaning solution compared with the deeper layers in compartment 16. However, with the provision of the special tube 44, a thorough mixing action is achieved when dispensing of cleaning solution, i.e. detergent solution, is to take place. Thus, the deeper layers are disturbed at this stage, and the result is the dispensing of a much more uniform concentration of solution.

Referring now to FIGS. 4–7, there will be seen the several stages in the operation of the dispenser of the present invention. In FIG. 4, the cross sectional view is through the tube or tower 32 and the associated intake-discharge opening 30. In FIG. 4 it is assumed that the tank water level has just reached the rim of the cap 36 on the venting means or tube 32. Due to hydrostatic equilibrium, the level inside the tube 32 is the same. However, once the rim of cap 36 is reached by the tank water, there will be an automatic stop, due to the liquid seal, of the rise of cleaning solution in tube 32. This bent tube effect has already been described in related application Ser. No. 421,170.

Figure 2:
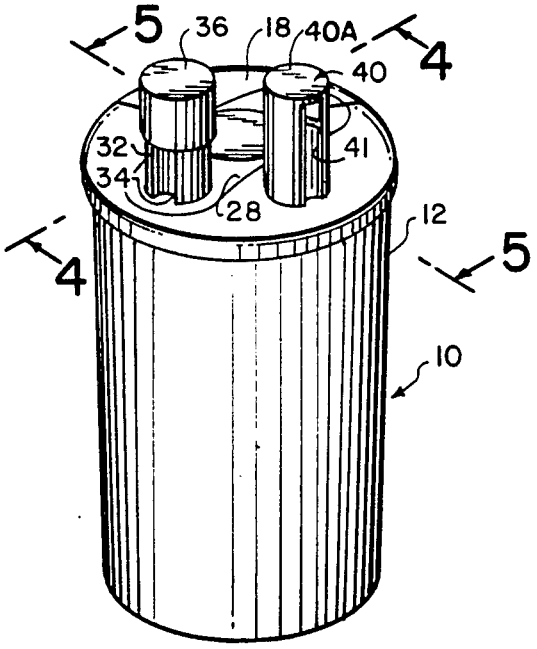
FIG. 2 is another perspective view of the dispenser from a vantage point somewhat different from that of FIG. 1.
Figure 3:
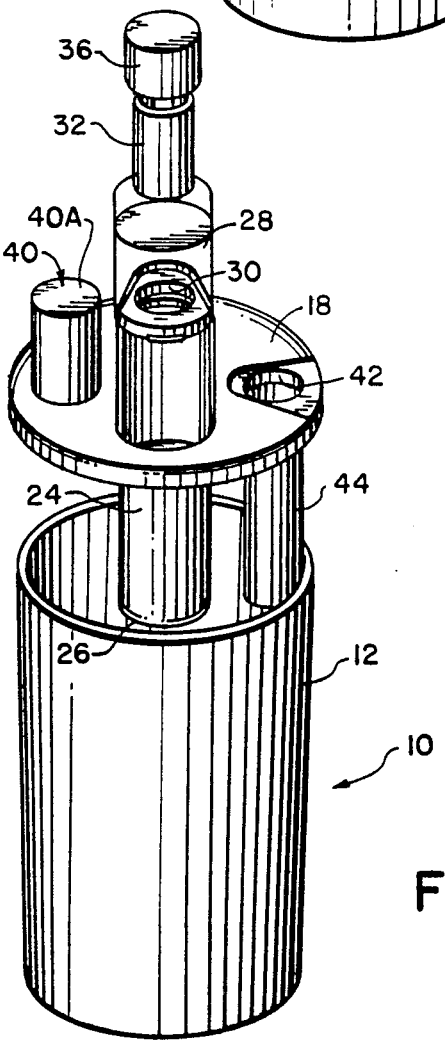
FIG. 3 is an exploded view of the dispenser.

In contrast with FIG. 4, the cross sectional view of FIG. 5 is taken on the line 5—5 of FIG. 2 and is a cross-section through the container, specifically, through the tower 40 and the associated intake-discharge opening 42. At this stage, the water in the tank has risen to the level indicated. There is no automatic stop with respect to the rise of the cleaning solution, that is, the detergent solution in the tube 40. Instead, there is some limited outflow of the detergent cleaning solution because of the side hole 41. Were this hole to be constructed at the top of the closed end of tube 40, there would be substantially more outflow of detergent solution.

It should be noted that there is a trade-off involved in permitting this limited outflow of detergent solution in order to gain an advantage to be discussed. Referring now to FIG. 6, there will be seen a stage at which the water level has dropped just slightly below the upper end of side opening 41. At this point, air is able to enter tube 40 and to cause an initial burst of detergent solution to discharge through opening 42 in container 12. Consequently, as indicated by the arrow 43 (FIG. 6) at the intake-discharge opening 42, an amount of detergent solution, equivalent to that present in tube 40 under static conditions, normally begins to be dispensed into the tank water. As a further result, however, due to the presence of the side opening 41, tank or flush water can now flow into the tube 40 and cause an incremental amount of cleaning solution, on the order of 20% greater than the amount of solution initially present in tube 40, (the measured amount) to be discharged through the opening 42.

The aforenoted mixing action, as indicated by the arrow 45 running through compartment 16, is promoted at the deeper layers of the solution present in the reservoir. Thus due to the presence of the tube 44, there cannot be skimming off of the upper layers of the solution reservoir.

A subsequent stage, at which the flush water has reached the level just below the bottom of opening 41, is depicted in FIG. 7. Here there can be no further intake of flush water into the tube 40; and as depicted, the tube 40 is now partially empty and the dose amount has been partially dispensed into the flush water to be carried into the toilet bowl (not seen). In the fragmentary showing of flush water 48 in the tank 50, it will be noted that the dispensing device 10 is shown resting at the bottom of the tank. However, it will be understood that if it turned out to be desirable to have a quick discharge into the flush water of the requisite measured amount of cleaning solution at an earlier stage of the flushing cycle, hanger means could be provided such that the dispensing device 10 could be hung from the top of the toilet tank 50.

In order for the man skilled in the art to practice the invention in a detailed way, the following specifications are provided in connection with the construction of one example of the device of the present invention.

The dispenser 10 as seen in the figures is formed by molding of a plastic such as polyethylene and the like. The overall height of the container is approximately 4¾ inches with a diameter of approximately 2¾ inches. Each of the intake-discharge openings 30 and 42 has a diameter of 5/16 inches. The volume of the bleach compartment 20 is approximately 3.75 cubic inches; the towers or tubes 32 and 40 are each approximately ¾ of an inch in height and with an inside diameter of approximately 7/16 inches. As noted previously, the opening 41 in the tube 40 has an area of approximately 1/16 square inches. Inner tube 44 has a length of 1.5 inches and the same diameter as opening 42.

It should be especially noted that in the example already given of the dispenser device 10 having a height of approximately 4¾ inches, then with such device resting on the bottom of a tank containing water at a height of approximately 20 inches, the co-dispensing of bleach and detergent solution, as described, from the respective intake-discharge openings 30 and 42, will take place after the first 75% of the tank water has been flushed out; and therefore the bleach and detergent will exit into and remain in the bowl until the next flush.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A toilet bowl cleaner dispenser for automatically discharging a predetermined amount of cleaning solution into the flush water of a toilet tank, said device comprising:

a container having a substantially horizontal, top wall and an intake-discharge opening through said top wall for enabling flush water to enter and form a reservoir of cleaning solution in the container, and for enabling the predetermined amount of solution to discharge through said intake opening during flushing;

a venting means, including a vent opening spaced laterally from said intake-discharge opening and extending through said top wall, for solely defining a measured amount of solution to be dispensed, said venting means communicating with the interior of said container by means of said vent opening so as to vent air responsive to the intake of flush water through said intake-discharge opening;

said venting means being in the form of an upstanding tube extending above said vent opening, which tube is closed by means of a wall at its upper end, said tube having a side opening immediately adjacent the closed upper end for enabling a further amount of solution, beyond said measured amount, to be discharged from said intake opening;

said venting means being operable such that as the flush water rises and enters said container through said intake-discharge opening the cleaning solution rises and completely fills said tube to a level above said intake-discharge opening, thereby metering an amount of solution external to said reservoir, such amount being the aforesaid measured amount;

the said measured amount of solution remaining in the venting means until the flush water in the tank is lowered to a point corresponding to the top of said tube, whereby the measured amount descends into said reservoir and displaces from said reservoir through said intake-discharge opening an amount of cleaning solution equivalent to said measured amount, and said further amount flows from said intake-discharge opening corresponding with an incremental amount of flush water which is permitted to enter said venting means at said point due to said side opening.

2. A device as defined in claim 1, including a container containing two different cleaning materials; another venting means in the form of a second upstanding tube having a first portion adjacent to, and communicating by means of another vent opening through said top wall with, the interior of said container and with one of said cleaning materials; said second tube having a second, depending portion with a distal opening communicating with said flush water; complete filling of said second tube by cleaning solution being prevented by trapped air inside said tube due to a water seal formed at said distal opening of the second portion when the flush water rises to said distal opening; a second intake-discharge opening spaced laterally from said another vent opening associated with said another venting means, said second intake-discharge opening being spaced laterally from said another vent opening and extending through said top wall.

3. A device as claimed in claim 2, in which an additional tube extends from said intake opening downwardly within the container, such that when the measured amount falls from said venting means there will be mixing action for the cleaning solution in said container as it is being dispensed.

4. A device as defined in claim 3, in which first and second compartments are provided within said container; a first main cover for closing said container and a second cover for closing said second compartment, the second compartment being defined by at least one wall depending from the main cover for said container, the first compartment being defined by the remainder of the volume of said container; the one venting means and the other venting means being in communication with their respective compartments.

5. A device as defined in claim 4, in which a bottom wall also defines said second compartment, said bottom wall being substantially elevated with respect to the bottom wall of said container.

6. A device as defined in claim 2, in which the tube of said another venting means has an axially extending peripheral groove, and a removable cap over the upper end thereof.

* * * * *

UNITED STATES PATENT AND TRADEMARK OFFICE

CERTIFICATE OF CORRECTION

PATENT NO. 4,635,302

DATED January 13, 1987

INVENTOR(S) : John E. Dolan

It is certified that error appears in the above-identified patent and that said Letters Patent are hereby corrected as shown below:

In the Abstract:

Col. 2, line 20, change "obstructed" to —unobstructed—

Signed and Sealed this

Fourteenth Day of April, 1987

*Attest:*

DONALD J. QUIGG

*Attesting Officer*

*Commissioner of Patents and Trademarks*